US006497438B1

(12) United States Patent
Holub et al.

(10) Patent No.: US 6,497,438 B1
(45) Date of Patent: Dec. 24, 2002

(54) LATCH MECHANISM AND HOUSING

(75) Inventors: Timothy M. Holub, Cheney, KS (US); Glen Bellows, Valley Center, KS (US)

(73) Assignee: The Coleman Company, Inc., Wichita, KS (US)

( * ) Notice: Subject to any disclaimer, the term of this patent is extended or adjusted under 35 U.S.C. 154(b) by 5 days.

(21) Appl. No.: 09/594,458

(22) Filed: Jun. 15, 2000

(51) Int. Cl.[7] ..... E05B 15/02

(52) U.S. Cl. ..... 292/341.13; 292/341.15; 292/38; 292/240; 292/DIG. 38; 292/DIG. 50; 292/DIG. 65

(58) Field of Search ..... 292/341.13, 341.15, 292/38, 44, 240, 241, DIG. 38, DIG. 50, DIG. 65, DIG. 30, DIG. 71, DIG. 9, DIG. 16

(56) References Cited

U.S. PATENT DOCUMENTS

| | | | | | |
|---|---|---|---|---|---|
| 120,192 | A | * | 10/1871 | Greenough | 292/190 |
| 217,146 | A | * | 7/1879 | Quackenbush | 292/190 |
| 1,510,292 | A | * | 9/1924 | Anderson | 24/110 |
| 2,455,772 | A | * | 12/1948 | Jackle | 292/88 |
| 2,772,106 | A | * | 11/1956 | Semelka | 292/18 |
| 3,690,708 | A | * | 9/1972 | Worley et al. | 292/101 |
| 4,181,338 | A | * | 1/1980 | Sterling | 292/341.17 |
| 4,502,715 | A | | 3/1985 | Lundblade | |
| 4,709,949 | A | * | 12/1987 | Umezawa | 292/6 |
| 4,904,007 | A | | 2/1990 | Woodruff | |
| 4,973,092 | A | * | 11/1990 | Godbe et al. | 292/190 |
| 5,165,430 | A | * | 11/1992 | Porter | 132/279 |
| 5,678,948 | A | * | 10/1997 | White | 403/321 |
| 5,997,056 | A | * | 12/1999 | Yamagishi | 292/341.17 |
| 6,038,892 | A | * | 3/2000 | Schmitt | 70/78 |

* cited by examiner

*Primary Examiner*—Jack Lavinder
*Assistant Examiner*—Benjamin A Pezzlo
(74) *Attorney, Agent, or Firm*—Kramer, Levin, Naftalis & Frankel, LLP

(57) ABSTRACT

A latch assembly comprising a latch mechanism and latch housing wherein the latch assembly is useful for containers such as coolers in which it is desired that the cooler lid be secured to the container to keep the contents in the cooler while allowing the cooler lid to be opened and closed without having to change the position of the latch mechanism securing the cooler lid to the body of the cooler. The latch mechanism is mounted to the body of the cooler. The latch housing is mounted to the cooler lid and comprises a receptacle member and a clip which applies pressure to the receptacle member. The latch housing is designed to fit the latch hook and to automatically align the latch hook as it is rotated into the latch housing. The latch housing may also be part of the cooler lid handle used for gripping the cooler lid when opening or closing the lid.

17 Claims, 3 Drawing Sheets

LATCH MECHANISM AND HOUSING

FIELD OF THE INVENTION

The present invention relates to latch assemblies; specifically to a latch assembly comprising a latch mechanism and housing for use with containers, especially coolers, that can be opened or closed with a lid.

BACKGROUND INFORMATION

In virtually every type of container, there exists some sort of securing device which operates to keep the contents of the container shielded from the environment. Such device is desirable for many reasons, such as to prevent the contents (i.e., food) of the container from being eaten by insects or to keep the contents of the container warm.

Each type of securing device for opening and sealing a container is designed based on the characteristics which are desirable for that container. In containers such as coolers which are useful for picnics or outdoor barbecues, it is desirable for the cooler lid to be secured to the body of the cooler to keep the contents in the cooler if the cooler gets knocked over. Yet, it is also desirable for the cooler lid to be easy to open and close without having to change the position of the device securing the lid to the body of the cooler. In other words, there is desired an alternative way to open and close the lid of the cooler other than having to move the securing device itself (i.e., by being releasably secured). In particular, it is desirable that the cooler lid can be opened (even when secured) such as by a child accidentally enclosed within the cooler without having to change the position of the securing device.

As known in the art, typical coolers lack such devices which can serve both purposes. For example, in one type of cooler, there is a cooler lid which is designed to fit snugly into the body of the cooler. When the cooler lid is snugly fit, the contents of the cooler are shielded from the sun and the effects of weather. However, when the cooler is knocked over, the momentum and impact with the ground often cause the cooler lid to open and the contents of the cooler to be spilled out.

In other types of coolers, there exists a releasing latch assembly such as that shown in U.S. Pat. No. 4,904,007, which is incorporated herein by reference. As shown in FIG. 4 of that patent, there is a latch having a keeper plate (36), and the latch is rotated until the keeper plate (36) is directly above the foot portion (2) of the spring latch (41) connected to the handle of the cooler lid. To secure the cooler lid to the body of the cooler, the handle of the latch is then turned to lower the keeper plate (36) so that the keeper plate (36) will partially overlap and rest on foot portion (2) of the spring latch (41) as illustrated in FIG. 5 of that patent. As shown in FIG. 6 of the aforementioned patent, the flexibility of spring latch (41) allows the cooler lid to be opened by exertion of an upward force without changing the position of the latch. However, as shown in FIG. 8 of the aforementioned patent, this latch assembly is designed to prevent the cooler lid from being fully closed and relatched until the latch handle is rotated so that the keeper plate (36) is moved out of its current position.

SUMMARY OF THE INVENTION

In an exemplary embodiment, the present invention allows a cooler lid to be secured to the cooler to keep the contents in the cooler while also allowing the cooler lid to be opened and closed without having to change the position of the latch mechanism which secures the cooler lid to the body of the cooler. There is provided a latch assembly comprising a latch mechanism and a latch housing. The latch mechanism is connected to the body of the cooler and includes a latch hook having a fitting end adapted for engagement with the latch housing.

The latch housing is connected to the cooler lid and comprises a receptacle member and a clip which applies pressure to the receptacle member. The latch housing is uniquely designed to engage the fitting end of the latch hook and to automatically align the latch hook as it is rotated into the latch housing. The latch housing may also be part of the cooler lid handle used for gripping the cooler lid when opening or closing the lid.

In the exemplary embodiment, the latch hook and latch housing are designed so that the cooler lid can be secured to the cooler body by rotating the latch hook into the latch housing or by applying sufficient downward force on the cooler lid such that the latch hook will slip into the latch housing.

In the exemplary embodiment, the latch hook and latch housing are designed so that the cooler lid can be released from the cooler body by rotating the latch hook out of the latch housing or by applying sufficient upward force on the cooler lid such that the latch hook will slip out of the latch housing.

DETAILED DESCRIPTION OF THE INVENTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details. Furthermore, well known features may be omitted or simplified in order not to obscure the present invention.

Figure 7:
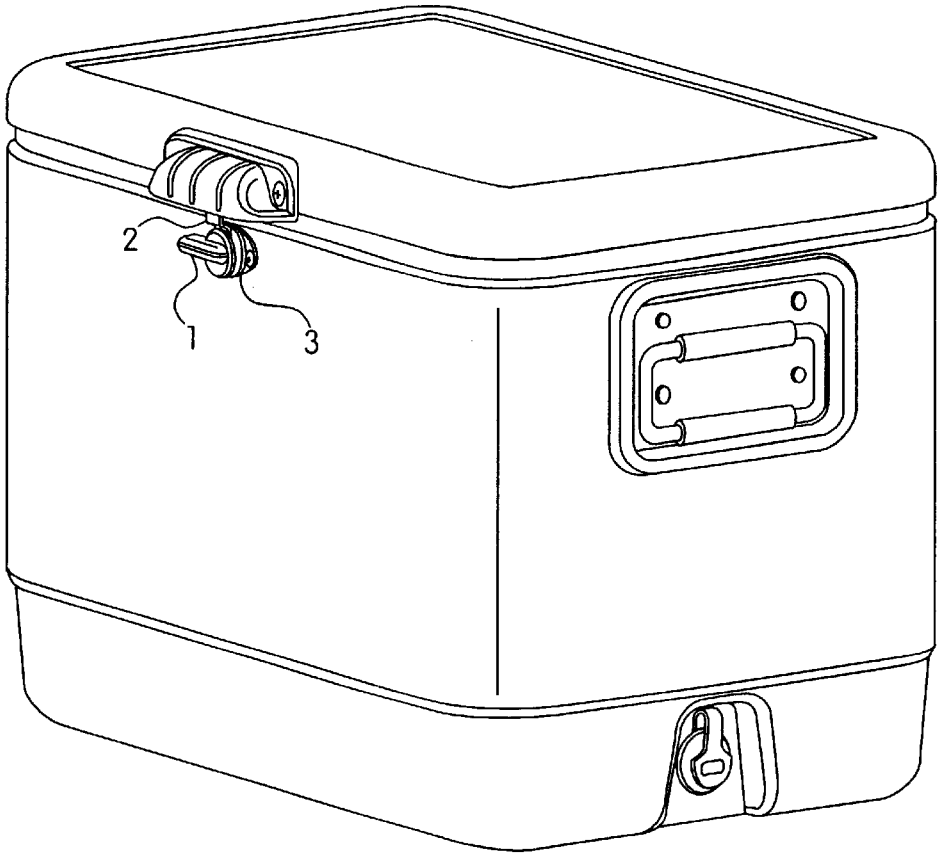
FIG. 7 is a perspective view of a cooler with an embodiment of a latch assembly in accordance with the present invention.

In an exemplary embodiment, there is provided a latch assembly comprising a latch mechanism and latch housing which secures the container lid to the body of the container. In the exemplary embodiment shown, the latch assembly will be described as used with coolers. As illustrated in FIG. 7, a latch mechanism is attached to the body of the cooler. The visible components of the latch mechanism in FIG. 7 are the latch handle 1, latch hook 2, and latch base 3. The top of latch hook 2 is inserted into the latch housing, which in FIG. 7, is located in the handle of the cooler lid. In an alternative embodiment, the locations of the latch mechanism and latch housing can be reversed (i.e., the latch mechanism on the cooler lid and the latch housing on the booler body).

Figure 1:
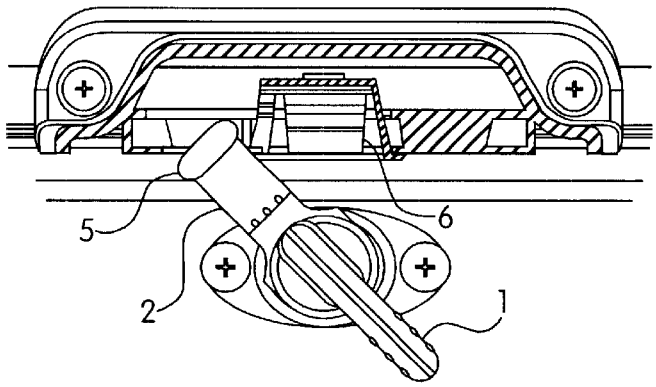
FIG. 1 is a front view of an embodiment of a latch assembly in accordance with the present invention wherein the latch hook of the latch mechanism is not positioned within the latch housing.
Figure 3:
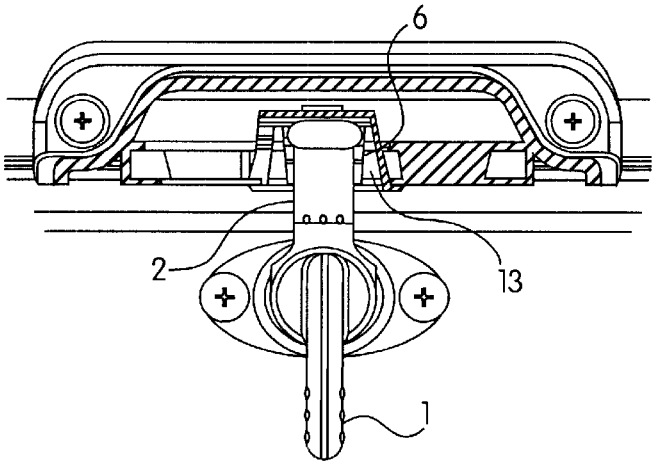
FIG. 3 is a front view of an embodiment of a latch assembly in accordance with the present invention wherein the latch hook of the latch mechanism is positioned within the latch housing and the latch handle is 180 degrees opposite the fitting end of the latch hook.
Figure 5:
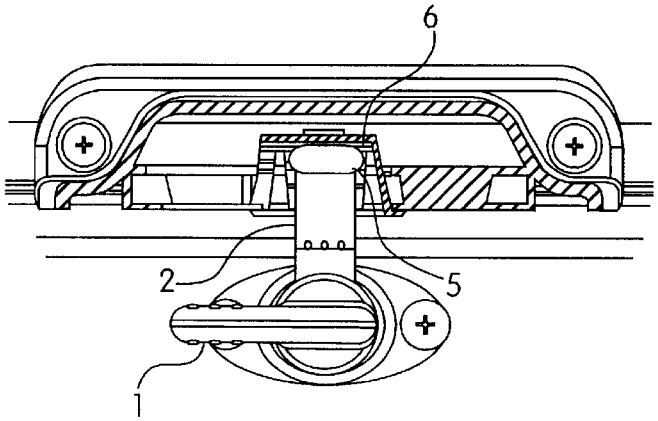
FIG. 5 is a front view of an embodiment of a latch assembly in accordance with the present invention wherein the latch hook of the latch mechanism is positioned within the latch housing and the latch handle is perpendicular to the fitting end of the latch hook.

FIGS. 1, 3, and 5 illustrate how the latch mechanism and latch housing interact with each other to secure the cooler lid to the cooler body. As shown in FIG. 1, in the initial position, the latch hook 2 is not yet positioned in latch housing 6. As shown in FIG. 3, the rotation of the latch handle 1 in the clockwise direction into a vertical position also causes the rotation of the latch hook 2 into a vertical position, thus, rotating latch hook 2 into the latch housing 6. Finally, as shown in FIG. 5, the latch handle 1 is rotated another ninety (90) degrees in the clockwise direction, resulting in the lowering of latch hook 2 within latch housing 6 to secure the cooler lid to the cooler body.

Figure 8:
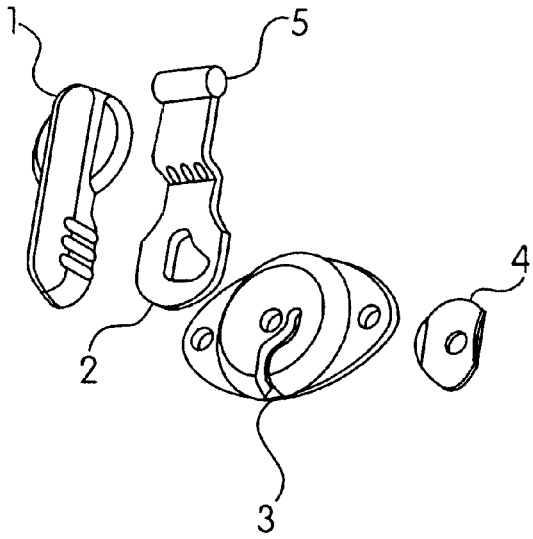
FIG. 8 is an exploded view of an embodiment of a latch mechanism in accordance with the present invention illustrating the alignment of a latch handle, latch hook, latch base, and washer.

As shown in FIG. 8, a latch mechanism according to an exemplary embodiment of the present invention comprises a latch handle 1, a latch hook 2, a latch base 3, and a washer 4. Such a latch mechanism is described in U.S. Pat. No. 4,904,007 which is incorporated herein by reference. The latch mechanism of the present invention, however, comprises latch hook 2 with a uniquely shaped fitting end 5 which is designed to be inserted into and engaged with a latch housing 6. Furthermore, as will become clear, the shape of the fitting end 5 is designed such that the cooler lid can be both opened and closed (i.e., releasably secured) with the latch hook 2 being in the vertical position without having to rotate the latch mechanism. Thus, while the fitting end 5 is shown to have a generally cylindrical shape with hemispherical ends, other alternative shapes may also work, such as a tubular shape or other shapes which may have an oval, circular, semicircular, quasi-circular, triangular, rectangular or multi-faceted cross sectional area. Fitting end 5 may be solid or hollow, or made of flexible material.

Figure 9:
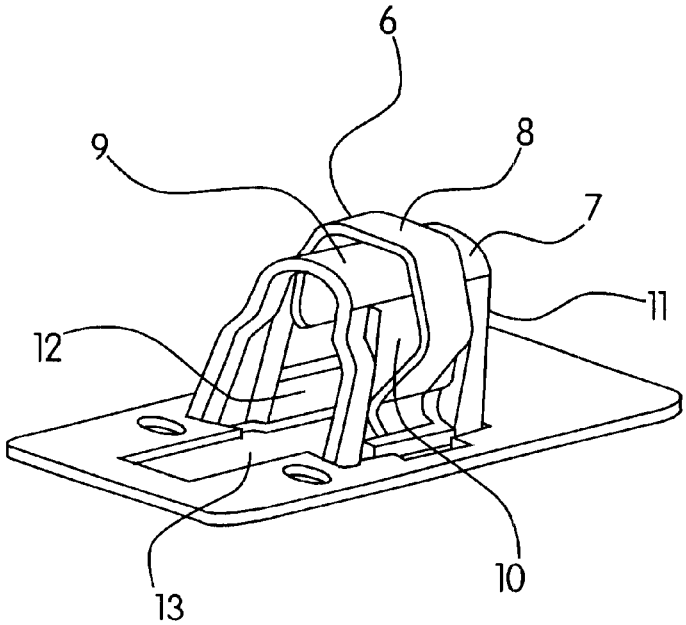
FIG. 9 is a perspective view of an embodiment of a latch housing in accordance with the present invention.

In the exemplary embodiment, there is also provided a latch housing 6, as illustrated in FIG. 9, which may be part of a handle on the cooler lid that the user may grip in order to open or close the lid. Latch housing 6 includes a receptacle member 7 and a clip 8. In the exemplary embodiment, the receptacle member 7 includes a top portion 9, two side flaps 10, and an end wall 11. The two side flaps 10 extend downward on opposite sides of top portion 9, and are shaped to receive therebetween the fitting end 5 of the latch hook 2. The two side flaps 10 are flexible and bend upon exertion of sufficient force. The receptacle member 7 can be made of plastic or any kind of polymer material or the like which may be bent when sufficient pressure or force is applied.

Figure 4:
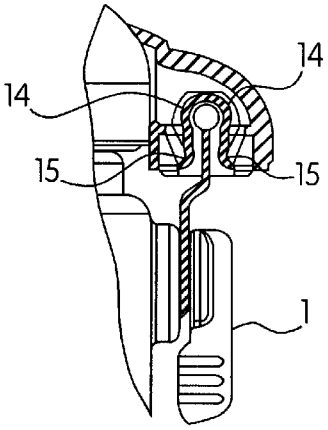
FIG. 4 is a side view of the latch assembly corresponding to FIG. 3.

Furthermore, as shown in FIG. 4 which includes a cross-sectional view of the receptable member 7, the interior of the two side flaps 10 each include an upper portion 14 and a lower portion 15. In the exemplary embodiment, the distance between the upper portions 14 is greater than the distance between the lower portions 15 of the two side flaps 10. Additionally, the distance between the upper portions 14 is preferably slightly greater than the width of the fitting end 5 of the latch hook 2, and the distance between the lower portions 15 is approximately the same or slightly less than the width of fitting end 5 of latch hook 2. For example, in the exemplary embodiment, the width (i.e., diameter) of fitting end 5 may be 0.25 inches, and the distance between the upper portions 14 may be 0.35 inches and the distance between the lower portions 15 may be 0.20 inches. The end of lower portions 15 may include a bulge 16. The distance between the bulges 16 represent the narrowest part of the receptable member 7 and may serve to ensure that the fitting end 5 will not be lowered or moved beyond the bottom of receptable member 7 unless sufficient force is applied.

This narrowing between the upper portions 14 and the lower portions 15 permits the latch housing 6 to automatically align the fitting end 5 of latch hook 2 as the fitting end 5 is rotated and then lowered into the latch housing. As such, when fitting end 5 is lowered in between the two lower portions 15, there is a secure fit between the side flaps 10 and the fitting end 5. Clip 8, which exerts pressure onto the the side flaps 10 of the receptacle member 7, helps to ensure a snug fit of fitting end 5 of latch hook 2 with latch housing 6. Clip 8 is preferably spring loaded and can be made of a resilient material such as a spring metal or the like.

Since the shape of the latch housing 6 should correspond to the portion of the latch hook 2 which it engages, in the exemplary embodiment, the receptacle member 7 in FIGS. 1–6 is generally U shaped so that it will provide a good fit for the cylindrical shaped fitting end 5 of latch hook 2.

The receptacle member 7 also includes a side opening 12 and a bottom opening 13. The side opening 12 is opposite end wall 11 and is configured so that fitting end 5 of latch hook 2 may enter or exit latch housing 6 through the side opening 12. The end wall 11, in addition to providing rigidity to the receptacle member 7, may also act as a barrier to prevent fitting end 5 from being inserted past the latch housing 6. The bottom opening 13 is opposite top portion 9 and is configured so that the fitting end 5 of the latch hook 2 may also enter or exit the latch housing 6 through the bottom opening 13.

Figure 2:
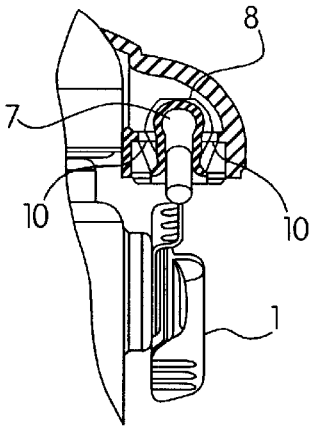
FIG. 2 is a side view of the latch assembly corresponding to FIG. 1.

Therefore, as shown in FIGS. 1 and 2, in the initial position, fitting end 5 of latch hook 2 is not yet positioned in latch housing 6 and thus, the cooler lid is not secured and may be easily opened and closed without resistance.

Figure 6:
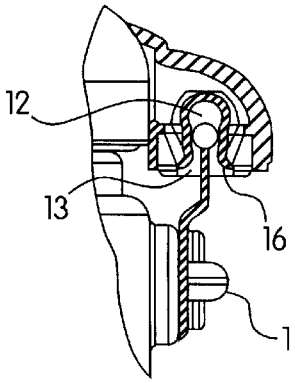
FIG. 6 is a side view of the latch assembly corresponding to FIG. 5.

In the exemplary embodiment, latch handle 1 is rotated clockwise into a vertical position as shown in FIGS. 3 and 4, resulting in the rotation of fitting end 5 of latch hook 2 into latch housing 6 through side opening 12. As shown in FIGS. 5 and 6, when latch handle 1 is rotated another ninety (90) degrees in the clockwise direction, fitting end 5 is lowered and automatically aligned within latch housing 6 by the decreasing distance between the upper portions 14 until the fitting end 5 becomes snugly fit between the lower portions 15 of the two side flaps 10. At this point, the cooler lid is secured (i.e., releasably secured as explained in the next paragraph) to the body of the cooler and if the cooler is knocked over, the cooler lid will not open and will prevent the contents of the cooler from spilling out.

On the other hand, if for example, an emergency arises while the fitting end 5 of latch hook 2 is positioned in latch housing 6, and the cooler lid needs to be opened immediately without having to rotate the latch mechanism, the cooler lid may be opened by exerting sufficient upward force on the cooler lid. Because the receptacle member 7 is made of a resilient, deformable material such as plastic or any polymer material or the like which may be slightly bent upon application of sufficient pressure or force, and the fitting end 5 of latch hook 2 is preferably shaped smoothly like a cylinder with no catching edges, the exertion of upward force on the cooler lid or handle causes the two lower portions 15 of the receptacle member 7 to expand outward slightly enough to allow the smooth surfaced fitting end 5 of latch hook 2 to slip out of the latch housing 6 through the bottom opening 13, therefore opening the cooler lid.

As a result of the design of the present invention, the converse is also true. In other words, if the latch hook 2 was in a vertical position as illustrated in FIGS. 5 or 6, the cooler lid can still be closed and secured without rotating out the latch hook 2 by exerting sufficient downward force on the cooler lid such that the impact of the smooth fitting end 5 with the two lower portions 15 of receptacle member 7 causes the two lower portions 15 to expand slightly enough to permit the fitting end 5 of latch hook 2 to slip into the latch housing 6 through bottom opening 13.

In the exemplary embodiment, to allow the cooler lid to be freely opened and closed, the latch handle 1 need only be rotated counterclockwise until the fitting end 5 of latch hook 2 is out of the latch housing 6. One skilled in the art will realize that the direction of rotation can be reversed as needed provided that one direction rotates the latch hook 2 into the latch housing 6 and the other direction rotates the latch hook 2 out of the latch housing 6.

While the exemplary embodiment of the present invention has been described on coolers, one skilled in the art will also recognize that the present invention can be used on virtually any type of container in which it is desirable that a container lid (a) be secured to the body of the container to keep the contents in the container, and (b) be capable of being opened and closed upon exertion of sufficient force without having to change the position of the device securing the lid to the body of the container. Further, one skilled in the art will realize that various changes and modifications may be made to the invention without departing from the spirit of the invention, and it is intended to claim all such changes and modifications as falling within the scope of the invention.

What is claimed is:

1. A latch mechanism comprising:

a latch handle;

a latch hook, the latch hook including a fitting end adapted for engagement with a latch housing wherein the fitting end is cylindrically shaped and is capable of engaging the latch housing by being rotated into the latch housing and by penetrating the latch housing; and a latch base;

wherein the rotation of the latch handle causes the fitting end of the latch hook to either rotate in the same direction as the latch handle or to move away or toward the latch base.

2. The latch mechanism of claim 1, wherein the fitting end of the latch hook has a smooth surface.

3. A latch housing comprising:

a receptacle member, the receptacle member including a top portion, side flaps, and an end wall, the side flaps adapted to releasably secure a fitting end of a latch hook upon engagement of the latch hook with the receptacle member; and a clip, wherein the clip is spring loaded to exert pressure on the side flaps of the receptacle member;

wherein the receptacle member includes a side opening and a bottom opening; and wherein the receptacle member is adapted for engagement with a fitting end of a latch mechanism through the side opening or the bottom opening.

4. The latch housing of claim 3, wherein each one of said side flaps includes an upper portion and a lower portion, the distance between the upper portion of each said side flap being greater than the distance between the lower portion of each said side flap.

5. The latch housing of claim 4, wherein the lower portion of at least one said side flap includes a bulge.

6. The latch housing of claim 3, wherein the receptable member is made from plastic.

7. The latch housing of claim 3, wherein the receptacle member is generally U shaped.

8. A latch assembly comprising:

a latch mechanism; and a latch housing, the latch mechanism including a latch hook having a fitting end adapted for engagement with the latch housing; and the latch housing comprising a receptacle member, the receptacle member including a top portion, side flaps, an end wall, a side opening and a bottom opening, the receptacle member being adapted for engagement with the fitting end of the latch hook, wherein the fitting end of the latch hook may enter the latch housing through the side opening or the bottom opening, the side flaps adapted to releasably secure the fitting end upon engagement with the receptacle member;

and a clip, wherein the clip is spring loaded to exert pressure on the side flaps of the receptacle member.

9. The latch assembly of claim 8, wherein the fitting end of the latch hook of the latch mechanism is cylindrically shaped.

10. The latch assembly of claim 9, wherein the fitting end of the latch hook of the latch mechanism has a smooth surface.

11. The latch assembly of claim 8, wherein each one of said side flaps includes an upper portion and a lower portion, the distance between the upper portion of each said side flap being greater than the distance between the lower portion of each side flap.

12. The latch assembly of claim 11, wherein the lower portion of at least one said side flap includes a bulge.

13. The latch assembly of claim 8, wherein the receptacle member is made from plastic.

14. The latch assembly of claim 8, wherein the receptacle member is generally U shaped.

15. The latch assembly of claim 8, wherein the receptacle member includes a side opening and a bottom opening.

16. A latch assembly for releasably securing a cooler lid to a body of a cooler, the latch assembly comprising:

a latch mechanism and a latch housing, the latch mechanism being attached to the body of the cooler and the latch housing being attached to a cooler lid, the latch mechanism including a fitting end adapted for engagement with the latch housing, and the latch housing including a side opening and a bottom opening, wherein the cooler lid may be releasably secured to the body of the cooler by rotating the fitting end of the latch mechanism through the side opening of the latch housing or forcing the fitting end of the latch mechanism through the bottom opening of the latch housing.

17. The latch assembly of claim 16 wherein the fitting end of the latch mechanism is cylindrically shaped.

* * * * *